US005952984A

United States Patent [19]

Kuramoto et al.

[11] Patent Number: 5,952,984

[45] Date of Patent: Sep. 14, 1999

[54] LENS ANTENNA HAVING AN IMPROVED DIELECTRIC LENS FOR REDUCING DISTURBANCES CAUSED BY INTERNALLY REFLECTED WAVES

[75] Inventors: Akio Kuramoto; Kosuke Tanabe, both of Tokyo, Japan

[73] Assignee: NEC Corporation, Tokyo, Japan

[21] Appl. No.: 08/866,031

[22] Filed: May 30, 1997

[30] Foreign Application Priority Data

May 30, 1996 [JP] Japan ..... 8-158837

[51] Int. Cl.[6] ..... H01Q 15/08

[52] U.S. Cl. ..... 343/911 R; 343/753; 343/786

[58] Field of Search ..... 343/911 R, 753, 343/786, 756, 909, 910; H01Q 15/08

[56] References Cited

U.S. PATENT DOCUMENTS

| | | | |
|---|---|---|---|
| 3,329,958 | 7/1967 | Anderson | 343/753 |
| 4,447,811 | 5/1984 | Hamid | 343/786 |
| 5,706,017 | 1/1998 | Buttgenbach | 343/753 |

*Primary Examiner*—Don Wong
*Assistant Examiner*—Kimnhung Nguyen
*Attorney, Agent, or Firm*—Foley & Lardner

[57] ABSTRACT

A lens antenna is disclosed which comprises a conical horn and a lens attached to an aperture of the horn. The lens has a first planar surface at a first side which faces free space and a hyperboloid of revolution at a second side opposite the first side and is made of a dielectric material with relative permittivity ranging from 2 to 4. The lens is provided with a cylindrical portion which has a second planar surface parallel to the first planar surface and displaced from the first planar surface by a predetermined distance. The cylindrical portion being concentric with the lens.

13 Claims, 6 Drawing Sheets

LENS ANTENNA HAVING AN IMPROVED DIELECTRIC LENS FOR REDUCING DISTURBANCES CAUSED BY INTERNALLY REFLECTED WAVES

BACKGROUND OF THE INVENTION

1. Field of the Invention

The present invention relates generally to improvements in a lens antenna which comprises a dielectric lens attached to an aperture of a horn, and more specifically to a lens antenna which includes an improved dielectric lens for effectively lowering disturbances caused by electromagnetic waves internally reflected in the lens.

2. Description of the Related Art

As is known in the art, a lens antenna is comprised of a dielectric lens secured at an aperture (mouth) of a horn. The dielectric lens functions as a wave collimating element. A lens antenna is typically used in line-of-sight terrestrial microwave communications systems.

Before turning to the present invention it is deemed preferable to describe a known lens antenna with reference to FIG. 1.

FIG. 1 is a side view, partly sectional, of a known lens antenna, generally denoted by numeral 10, which comprises a plano-convex dielectric lens 12 and a conical horn 14 serving as a flared-out waveguide. The plano-convex lens 12 is made of a dielectric material such as polyethylene, polystyrene, etc. with a relative permittivity ranging about from 2 to 4. The lens 12 has plane surface 16 facing a free space and a hyperboloid of revolution (denoted by numeral 18) at the inner side. The horn 14 has a circular aperture to which the lens 12 is secured at its periphery. The horn 14 has an inner well covered with an electrically conductive layer, and has a flange 20 to which a corresponding flange 22 of a waveguide member 24 is attached. Reference numeral 26 denotes a wave guide.

As is well known in the art, the lens 14 transforms the spherical wave front of the wave radiated from a source 28 (i.e., primary antenna) into a plane wave front. To be more explicit, the field (viz., electromagnetic field) over the plans surface (viz., plans wave front) can be made everywhere in phase by shaping the lens so that all paths from the wave source 28 to the lens plane are of equal electrical length (Fermat's principle).

As shown in FIG. 1, part of a given incident wave 28 is reflected at two points of the lens 12: at the convex surface 18 (the reflected component is indicated by a broken line arrow 29) and at the plane surface 18. The reflection from the convex surface 18 does not return to the source 28 except from points at or near an axis 32 and thus are of no consequence. However, the energy reflected from the lens plans 16 returns back exactly along the radiation line 30 and may adversely affect the energy to be radiated from the wave source 26.

It is therefore highly desirable to reduce the above mentioned undesirable influence caused by the reflections from the plane lens surface.

SUMMARY OF THE INVENTION

It is therefore an object of the present to provide a lens antenna which has an improved dielectric lens for reducing disturbances caused by internally reflected waves.

One aspect of the present invention resides in a lens antenna comprising: a conical horn; and a lens attached to an aperture of said horn, said lens having a plane surface at a first side which faces a free space and a hyperboloid of revolution at a second side opposite the first side and being made of a dielectric material with relative permittivity ranging from 2 to 4, said lens being a circular lens with a diameter r, wherein said lens is provided with a cylindrical portion protruding from the plane surface of said tons, said cylindrical portion having a diameter of about r/3 and a height of about 0.17 $\lambda_0$ where $\lambda_0$ is a wavelength of a center frequency of a frequency range used with said lens antenna, said cylindrical portion being concentric with said lens.

Another aspect of the present invention resides in a lens antenna comprising: a conical horn; and a lens attached to an aperture of said horn, said lens having a plane surface at a first side which faces a free space and a hyperboloid of revolution at a second side opposite the first side and being made of a dielectric material with relative permittivity ranging from 2 to 4, said lens being a circular lens with a diameter r, wherein said lens is provided with a cylindrical portion recessed from the plane surface of said lens, said cylindrical portion having a diameter of about r/3 and a height of about 0.17 $\lambda_0$ where $\lambda_0$ is a wavelength of a center frequency of a frequency range used with said lens antenna, said cylindrical portion being concentric with said lens.

BRIEF DESCRIPTION OF THE DRAWINGS

The features and advantages of the present invention will become more clearly appreciated from the following description taken in conjunction with the accompanying drawings in which.

DETAILED DESCRIPTION OF THE PREFERRED EMBODIMENTS

A first embodiment of the present invention will be described with reference to FIGS. 2 to 6.

Figure 1:
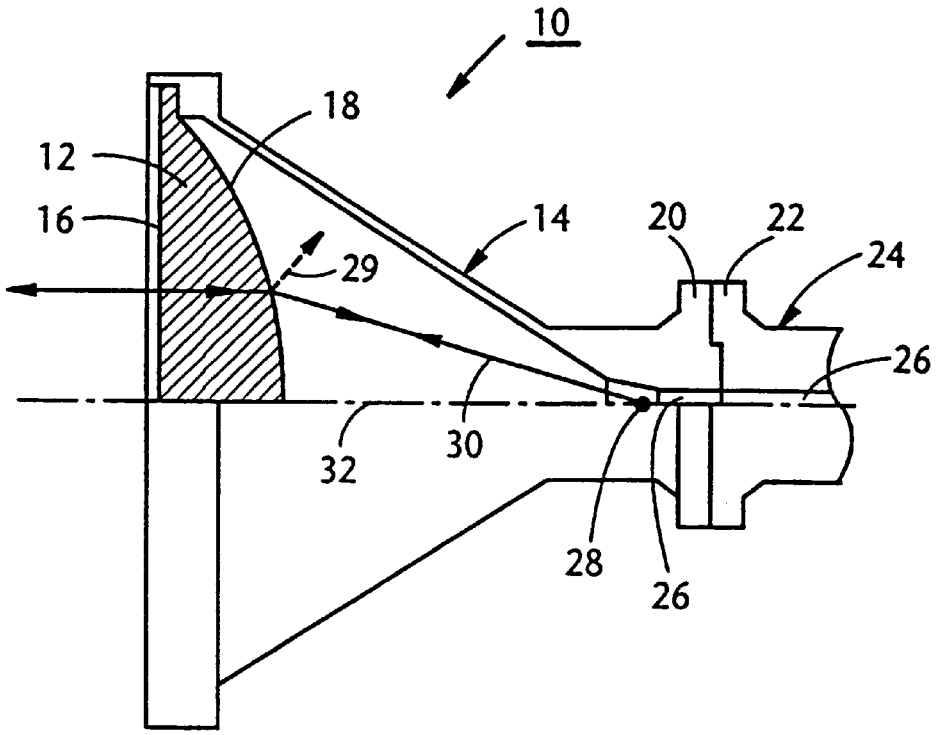
FIG. 1 (PRIOR ART)
FIG. 1 is a side view, partly sectional, of a lens antenna referred to in the opening paragraphs of the instant disclosure.
Figure 2:
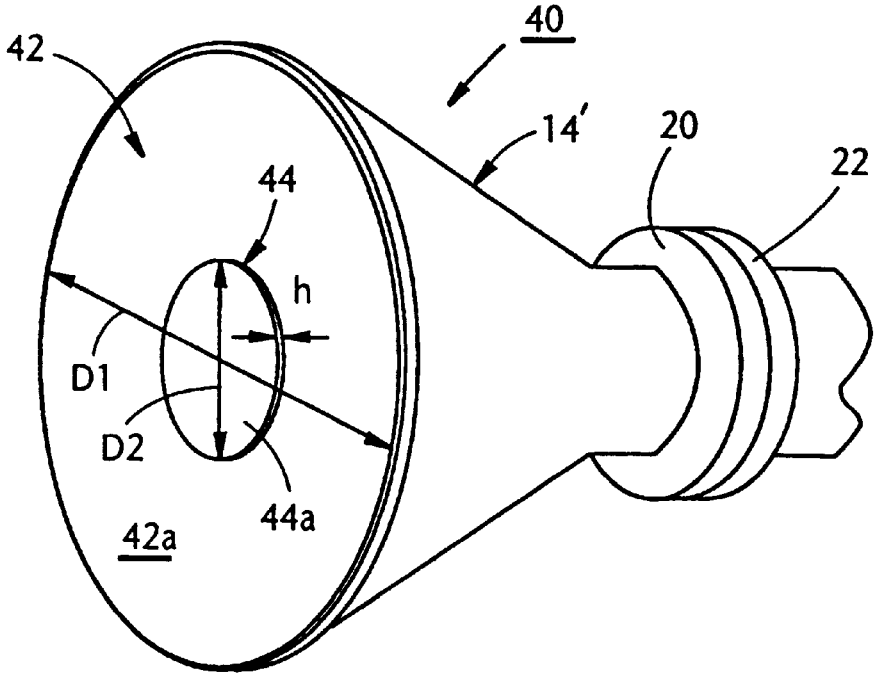
FIG. 2 is a perspective view of a lens antenna according to a first embodiment of the present invention.

FIG. 2 is a perspective view of a lens antenna 40 according to the first embodiment. The lens antenna 40 comprises a circular plano-convex dielectric lens 42 which is supported at the aperture of a conical horn 14', as in the prior art shown in FIG. 1. The lens 42 is made of a suitable dielectric material with relative permittivity ranging from 2 to 4. As shown, the lens 42 has a center portion which protrudes outwardly by a distance h. The protruded portion is substantially disk-shaped and thus hereinafter may be referred to as a disk or cylindrical portion 44. This disk portion 44 is formed on the lens 42 in a manner to be concentric therewith. It is to be noted that the disk portion 44 is part of the lens 42 and thus shaped when fabricating the lens 42. For the convenience of description, the plans surface of the disk portion 44 is denoted by numeral 44*a*, while the plane surface of the lens 42 except for the plane surface 44*a* is donoted by 42*a*. As in the prior art of FIG. 1, the lens 42 has a hyperboloid of revolution 18' at the inner side (see FIG. 3). The remaining portions of the lens antenna 40 are exactly the same as the counterparts of FIG. 1 and accordingly, the descriptions thereof will be omitted.

Designating the diameters of the lens 42 and the disk portion 44 as D1 and D2, respectively, it is preferable that the diameter D2 is set to about one third of D1 (viz., (D1)/3). This relationship of dimensions of D1 and D2 is determined as follows. It in known that the electromagnetic field near the edge of the lens 42 is less than that at and near the center thereof. That is, the amount of waves reflected from near the edge of the lens 42 differs from that at and near the center thereof. In order to effectively reduce the undesirable phenomenon caused by the reflected waves, it is highly desirable to equalize the amounts of waves reflected from the surfaces 42*a* and 44*a*. In view of this, it is preferable that the diameter D2 is determined so as to equal about one third of D1 (viz., (D1)/3).

Figure 3:
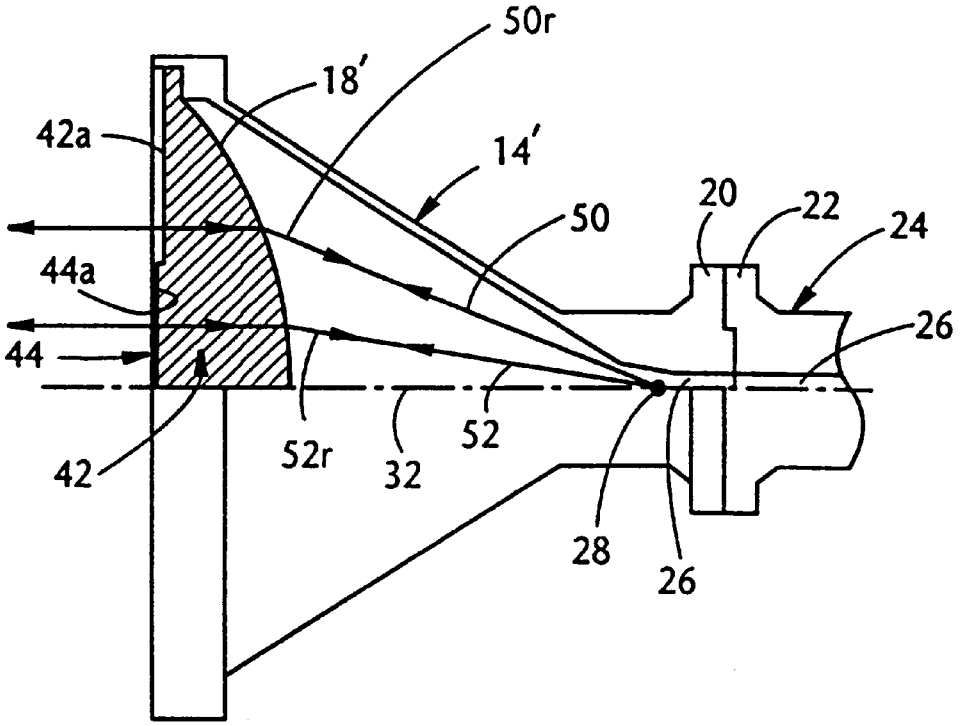
FIG. 3 is a side view, partly sectional, of the lens antenna of FIG. 2.

In FIG. 3, two waves 50 and 52, which originate from the wave source 26, are shown. The waves 50 and 52 are respectively directed such as to pass through the surfaces 42*a* and 44*a*. As mentioned above, the energy of each of the waves passing through the lens plane (such as 42*a* and 44*a*) is partly reflected from the plane boundary. In FIG. 3, notations 50*r* and 52*r* represent respectively the reflected waves of the waves 50 and 52. It is understood that the reflected wave 52*r* is retarded by the electrical path length of "2×h" compared to the reflected wave 50*r*. According to the study conducted by the inventors, it was found that the height "h" was preferably about 0.17 $\lambda_0$ ($\lambda_0$ is a wave length of a center frequency of a designed frequency range). This mean that the reflected wave 52*r* is retarded by 2×0.17 $\lambda_0$=0.34 $\lambda_0$ expressed in free space (air or vacuum) compared to the reflected wave 50*r*.

Further, the inventors conducted a computer simulation under the following conditions. That is to say, the lens 42 was made of polycarbonate with relative permittivity ($\epsilon_r$) of 2.85, while the diameters D1 and D2 were 200 mm and 60 mm, respectively. It is assumed that the available frequency band ranged from 37.00 GHz to 39.50 GHz and accordingly, the center frequency was 38.25 GHz ($\lambda_0$=7.84 mm) Therefore, the height "h" of the disk portion 44 was calculated using the following equation:

$$h=0.17\lambda_0/\epsilon_r^{1/2}\approx(0.17\times7.84)/2.85^{1/2}\approx0.8\text{ mm}$$

As mentioned above, the wave reflected from the plane surface 44*a* (such as 52*r*) is delayed 0.34 $\lambda_0$ (expressed in free space (air or vacuum)) as compared to the wave reflected at the plane surface 42*a* (such as 50*r*).

One particular example showing the advantage of the first embodiment over the prior art will be discussed. First, the case where the above mentioned disk portion 44 is not provided is given (as in the prior art shown in FIG. 1).

Defining the parameters associated with the lens plane 16 as follows:

$E_{1i}$: wave incident on the lens plane 16;

$E_{1t}$: wave passing through the plane 16;

$E_{1r}$: wave reflected from the plane 16; and $R_1$: reflection coefficient (vector) at the plane 16.

Further, assuming:

$$|R_1|=|E_{1r}/E_{1i}|=0.3 \quad (1)$$

Since the reflection loss RL is given by 10 log$|R|^2$, then $$RL=10\log|R|^2=20\log|R|=20\log 0.3=-10.5\text{ (dB)} \quad (2)$$

On the other hand, in connection with the first embodiment, the parameters associated with the plane 44*a* of the disk portion 44 are defined as follows:

$E_{2i}$: the wave incident on the lens plans 44*a;*

$E_{2t}$: wave passing through the plane 44*a;*

$E_{2r}$: the wave reflected from the plane 44*a;* and $R_2$: refection coefficient (vector) at the plane 44*a*.

Further, the parameters associated with the plane 42*a* of the lens 42 are defined as follows;

$E_{3i}$: wave incident an the lens plans 42*a;*

$E_{3t}$: wave passing through the plane 42*a:*

$E_{3r}$: wave reflected from the plane 42*a;* and $R_3$: reflection coefficient (vector) at the plane 44*a*

$Rt=R_2+R_3$

Since $E_{2i}=E_{3i}$ and $|E_{24}|=E_{3r}|$, then $$Rt=R_2+R_3=\{|E_{2i}|^2/(|E_{2i}|^2+|E_{3i}|^2)\}^2\times(E_{2r}/E_{2i})+\{|E_{3i}|^2/(|E_{2i}|^2+|E_{3i}|^2)\}^2\times(E_{3r}/E_{3i})=(1/\sqrt{2}\cdot E_{2i})\times(E_{2r}+E_{3r}) \quad (3)$$

Therefore, the phase difference (denoted by θ) between $E_{24}$ and $E_{3r}$ is given by $$\theta=0.17\times2\times2\pi=0.68\pi$$

In the above, it is assumed that the wave amounts reflected at the planes 40*a* and 42*a* are equal each other.

Figure 4:
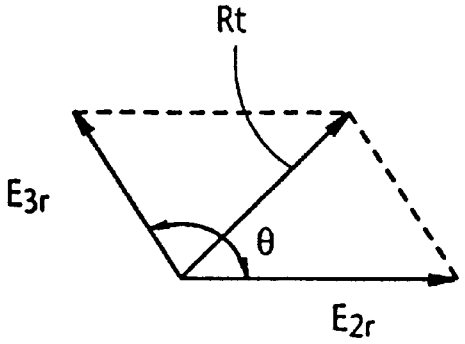
FIG. 4 is a vector diagram for use in describing the operations of the first embodiment.

FIG. 4 is a vector diagram showing the relationship of $E_{2r}$ and $E_{3r}$ whose phase difference is θ.

Assuming $|E_{2r}/E_{2i}|$=0.3, then we obtain $$Rt=1/\sqrt{2}\times0.3\{(1+\cos\theta)^2+\sin^2\theta\}=1/\sqrt{2}\times0.3\times0.964=0.204 \quad (4)$$

As a result, the reflection loss (denoted by RL') in the above case is as follows.

$$RL'=10\log|Rt|=-13.8\text{ dB} \quad (5)$$

It is understood, from the above computation, that the reflection loss can be reduced by 3.3 dB as compared to the prior art.

Figure 5:
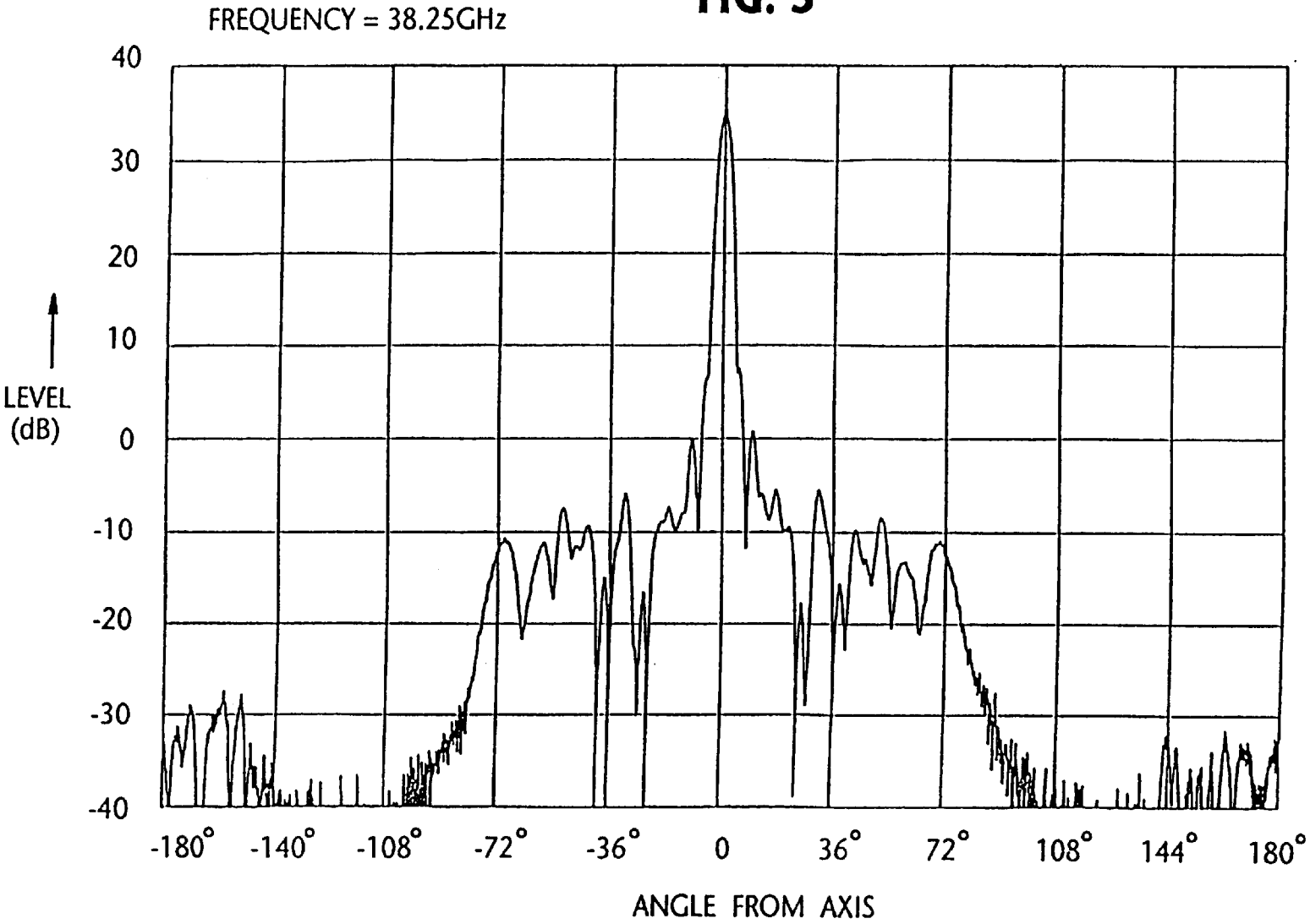
FIG. 5 is a graph showing a radiation pattern of the lens antenna according to the first embodiment.

The inventors conducted a computer simulation to determine a wave radiation pattern when a vertically polarized wave is applied from the waveguide 28. FIG. 5 is a graph showing the result of the computer simulation, which clearly indicates that a good radiation pattern can be obtained even if the disk portion 44 is formed.

Figure 6:
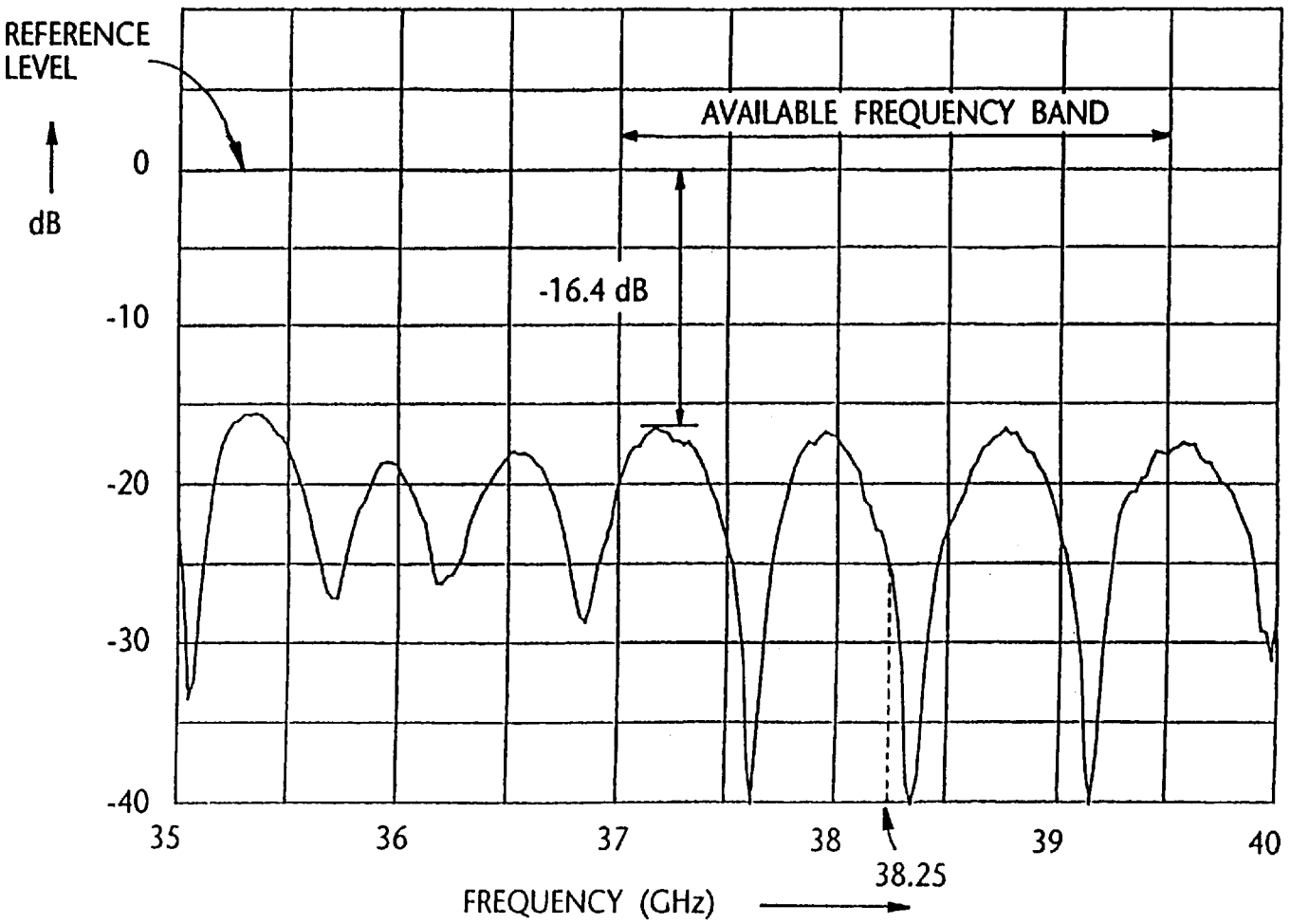
FIG. 6 is a graph showing reflection losses in the first embodiment.
Figure 7:
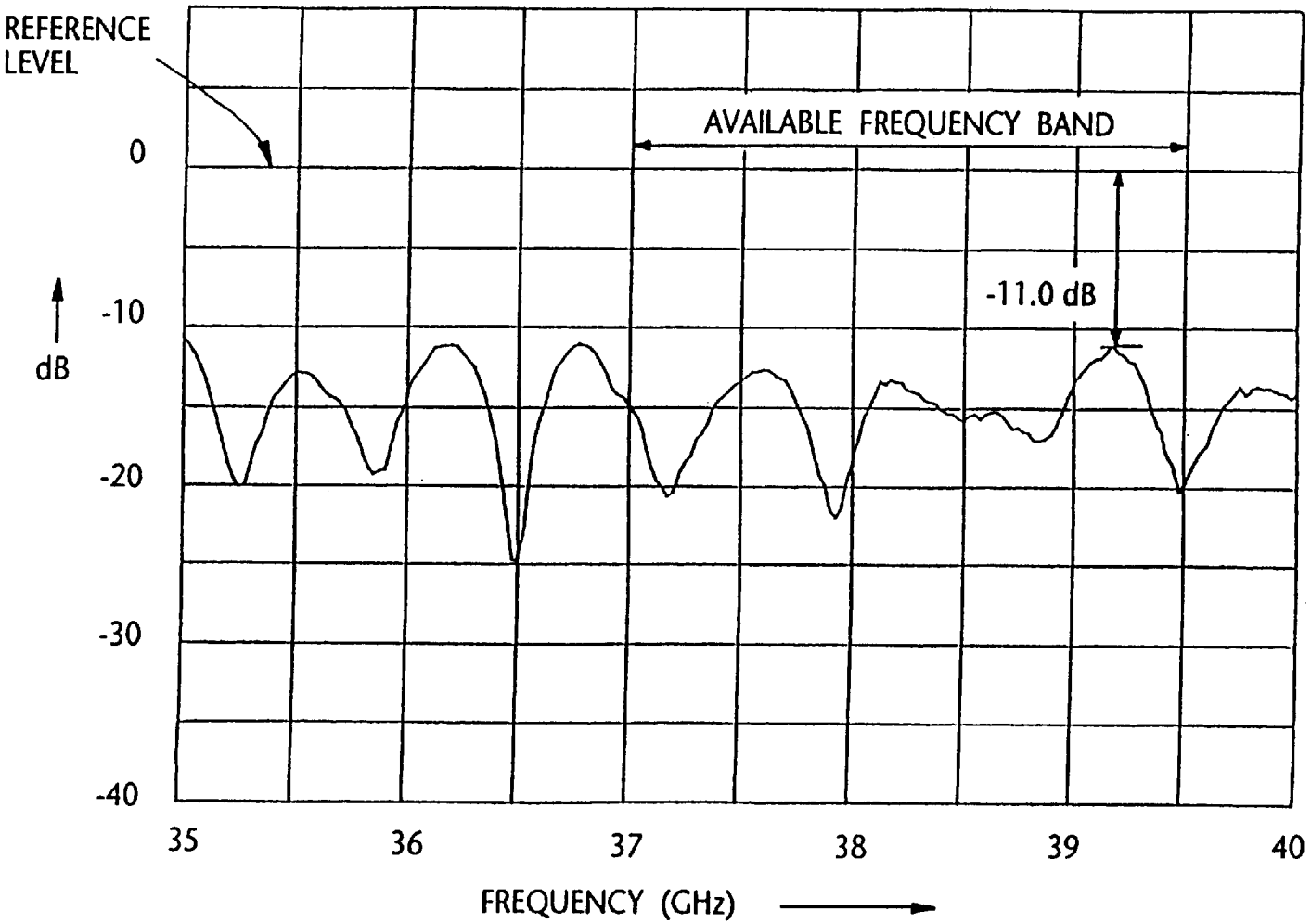
FIG. 7 (PRIOR ART)
FIG. 7 is a graph showing reflection losses in the prior art.

Further, the inventors investigated reflection losses occurring in the first embodiment (the result is shown in FIG. 6) and in the prior art (the result is show in FIG. 7), both over the frequencies ranging from 35 GHz to 40 GHz. This frequency range includes the frequency band (37.0 GHz to 39.5 GHz) over which the lens antenna embodying the present invention is preferably utilized. In this investigation, a reference level (0 dB) was determined when the waves radiated from the waveguide 28 were totally reflected at the plane surfaces of the lens 12 (FIG. 1) and 42 (FIG. 3). As shown in FIG. 6, the worst reflection loss in the first embodiment was about −16.4 dB. In contrast to this, the worst reflection loss in the prior art was about −11.0 dB as plotted in FIG. 7. That is, this examination indicates that the first embodiment was able to reduce the reflection loss by about 5.4 dB compared to the prior art.

Figure 8:
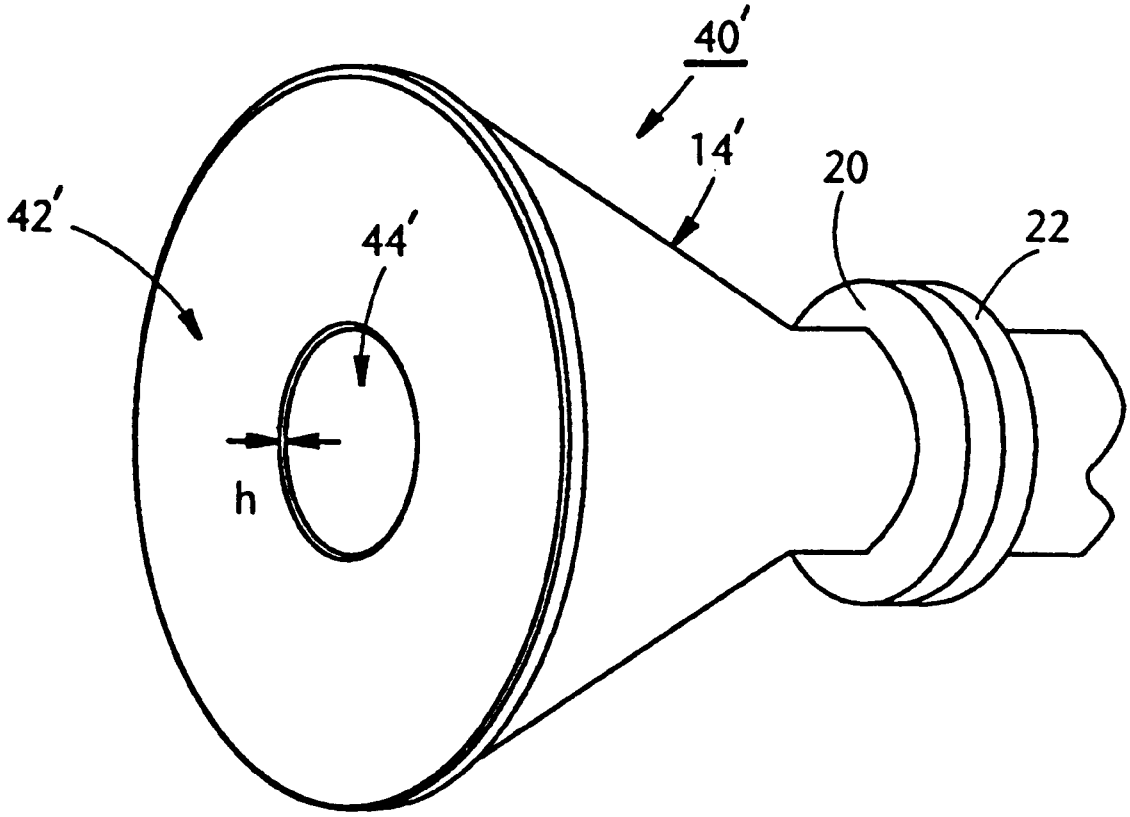
FIG. 8 is a perspective view of a lens antenna according to a second embodiment of the present invention.

FIG. 8 is a diagram showing a second embodiment of the present invention. As shown, a lens antenna 40' includes a dielectric lens 42' which has a cylindrical recess 44' with the depth h. Other than this, the second embodiment of FIG. 8 is identical to the first embodiment with respect to structure. With the second embodiment, each wave reflected from the inner surface of the recess 44' becomes shorter by 0.34-wavelength (2 h=0.34) than that reflected from the inner surface other than the recess 44'. It is understood that the operations as discussed above with respect to the first embodiment is applicable to those of the second embodiment.

It will be understood that the above disclosure is representative of only two possible embodiments of the present invention and that the concept on which the invention is based is not specifically limited thereto.

What is claimed is:

1. A lens antenna comprising:

a conical horn; and a plano convex lens attached to an aperture of said horn and collimating waves from said conical horn, said lens being a circular lens with a diameter r, said lens having a first planar surface at a first side which faces free space and a hyperboloid of revolution at a second side opposite the first side and being made of a dielectric material with relative permittivity ranging from 2 to 4.

characterized in that said lens is provided with a cylindrical portion which has a second planar surface parallel to the first planar surface and displaced from the first planar surface by a predetermined distance, said cylindrical portion being concentric with said lens.

2. A lens antenna as claimed in claim 1, wherein said cylindrical portion protrudes from the first planar surface and has a diameter of about r/3.

3. A lens antenna as claimed in claim 1, wherein the predetermined distance is about 0.17 $\lambda_0$ where $\lambda_0$ is a wavelength of a center frequency of a frequency range used with said lens antenna.

4. A lens antenna as claimed in claim 1, wherein said cylindrical portion protrudes from the first planar surface and has a diameter of about r/3 and wherein the predetermined distance is about 0.17 $\lambda_0$ where $\lambda_0$ is a wavelength of center frequency of a frequency range used with said lens antenna.

5. A lens antenna as claimed in claim 1, wherein said cylindrical portion is recessed from the first planar surface and has a diameter of about r/3.

6. A lens antenna as claimed in claim 5, wherein the predetermined distance is about 0.17 $\lambda_0$ where $\lambda_0$ is a wavelength of a center frequency of a frequency range used with said lens antenna.

7. A lens antenna comprising:

a conical horn; and a plano-convex lens attached to an aperture of said horn and collimating waves from said conical horn, said lens being a circular lens with a diameter r, said lens having a first planar surface at a first side which faces a free space and a hyperboloid of revolution at a second side opposite the first side and being made of a dielectric material with relative permittivity ranging from 2 to 4.

characterized in that said lens is provided with a cylindrical portion protruding from the first planar surface, said cylindrical portion having a diameter of about r/3 and a second planar surface parallel to the first planar surface and displaced from the first planar surface by a predetermined distance of about 0.17 $\lambda_0$ where $\lambda_0$ is a wavelength of a center frequency of a frequency range used with said lens antenna, said cylindrical portion being concentric with said lens.

8. A lens antenna comprising:

a conical horn; and a plano-convex lens attached to an aperture of said horn and collimating waves from said conical horn, said lens being a circular lens with a diameter r, said lens having a first planar surface at a first side which faces a free space and a hyperboloid of revolution at a second side opposite the first side and being made of a dielectric material with relative permittivity ranging from 2 to 4.

characterized in that said lens is provided with a cylindrical portion recessed from the first planar surface, said cylindrical portion having a diameter of about r/3 and a second planar surface parallel to the first planar surface and displaced from the first planar surface by a predetermined distance of about 0.17 $\lambda_0$ where $\lambda_0$ is a wavelength of a center frequency of a frequency range used with said lens antenna, said cylindrical portion being concentric with said lens.

9. A lens antenna comprising:

a conical horn; and a plano-convex lens attached to an aperture of said horn and collimating waves from said conical horn, said lens being a circular lens with a diameter r, said lens having a first planar surface at a first side which faces free space and a second side opposite the first side, characterized in that said lens is provided with a cylindrical portion which has a second planar surface parallel to the first planar surface and displaced from the first planar surface by a predetermined distance, said cylindrical portion being concentric with said lens.

10. A lens antenna as claimed in claim 9, wherein said cylindrical portion protrudes from the first planar surface.

11. A lens antenna as claimed in claim 9, wherein said cylindrical portion is recessed from the first planar surface.

12. A lens antenna as claimed in claim 9, wherein the cylindrical portion has a diameter of about r/3.

13. A lens antenna as claimed in claim 9, wherein the predetermined distance is about 0.17 $\lambda_0$ where $\lambda_0$ is a wavelength of a center frequency of a frequency range used with said antenna.

* * * * *